US005881497A

United States Patent [19]

Borgardt

[11] Patent Number: 5,881,497

[45] Date of Patent: Mar. 16, 1999

[54] AUTOMATIC DOOR OPENER ADAPTABLE FOR MANUAL DOORS

[76] Inventor: Ronald Borgardt, 2316 Tifton St., Kenner, La. 70062

[21] Appl. No.: 814,544

[22] Filed: Mar. 10, 1997

[51] Int. Cl.[6] ..... E05F 15/00

[52] U.S. Cl. ..... 49/139; 74/625

[58] Field of Search ..... 49/139, 140; 74/625

[56] References Cited

U.S. PATENT DOCUMENTS

| | | | |
|---|---|---|---|
| 4,348,835 | 9/1982 | Jones et al. | 49/139 |
| 4,553,656 | 11/1985 | Lense | 49/140 X |
| 4,660,324 | 4/1987 | Nyenbrink | 49/139 X |
| 4,966,266 | 10/1990 | Yamada et al. | 74/625 X |
| 5,024,124 | 6/1991 | Popov et al. | 74/625 |

*Primary Examiner*—Jerry Redman
*Attorney, Agent, or Firm*—Garvey, Smith, Nehrbass & Doody, LLC

[57] ABSTRACT

An automatic door opener adaptable to manual doors which includes a door hinged along at least one edge to a door frame, and manually movable between open and closed positions; an automatic door opener mechanism secured to the door, which further includes a motor; a first gear driven by the motor; at least an output gear for driving an output shaft secured to the door; a pair of gear dog portions on a face of the output gear defining free travel spaces therebetween; a pair of pins extending from the output shaft within the travel spaces, so that when the output gear is rotated by the motor, the gear dog portions engage the pins on the output shaft and rotate the door from a first closed position to a second opened position; a timer for allowing the door to remain in the opened position a pre-determined amount of time before returning to the closed position; and when the door is moved manually to the opened position and allowed to close, the pin members are not engaged by the gear dogs, and travel within the free travel spaces without imparting movement to any components of the automatic door mechanism.

14 Claims, 3 Drawing Sheets

AUTOMATIC DOOR OPENER ADAPTABLE FOR MANUAL DOORS

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The apparatus of the present invention relates to automatic door openers for manually operated doors. More particularly, the present invention relates to an automatic door opener that is adaptable to a manually operated door which allows for automatic opening of the door, yet when the door is opened manually, the manual opening of the door does not impact or effect any operation of the automatic opener for reducing wear and tear on the automatic opener.

2. General Background of the Invention

In the field of door openers, it is a required standard that doors which provide ingress and egress to public facilities have the ability to open automatically in order to allow passage through the doorway of people who are handicapped such as in wheelchairs, walkers or the like. Automatic door openers are quite common in companies such as Horton, Door-O-Matic, Beasom, and others, and have provided automatic door openers over an extended period of time. Normally, there is a mechanism which is engaged to the door frame and the door itself, so that when it is electronically activated, an arm of the like would move the door from the closed position to the open position and return it back to the closed position after passage through the doorway. Such a door may be operated either by an electric eye, or through a manual depression of a button or the like on a door frame.

For those door openers which are placed into automatic operation through the manual depression of a button or the like, in not all cases would the door have to be opener automatically, but if a person chose to, could move through the doorway manually as through any other doorway. This is currently found in the art. However, one of the drawbacks in such a feature is that as the door is pushed open and allowed to returned to the closed position by a manual door operator which would override the automatic system, in the current state of the art, the automatic system is still engaged to the door, and would operate as the door is opening and closing through the manual force of the person moving through the door. The problem with this is that because of the constant passage of people through the doorway, for example, through public doorways of office buildings or the like, the gear assembly which is normally part of the automatic door opener becomes worn over time, and the components of the automatic system, although not used that frequently by a handicapped person, or operated every time a person manually goes through the door and therefore, wear and tear is quite high on these types of systems.

Therefore, there is a need in the industry for a system which allows a door to have an automatic door operation component so that a person who is handicapped can move through the doorway easily. However, in the event a person moves the door to the open position manually, the door is allowed to open without engaging any of the components of the automatic door opener, and therefore saving on the wear and tear on the components in the automatic system which would be in use only when the power button is engaged.

BRIEF SUMMARY OF THE INVENTION

The apparatus of the present invention solves the shortcoming in the art in a simple and straight forward manner. What is provided is an automatic door opener adaptable to manual doors which includes a door hinged along at least one edge to a door frame, and manually movable between open and closed positions; an automatic door opener mechanism secured between the door and the door frame, which further includes a motor; a first gear driven by the motor; at least a second gear for driving an output shaft secured to the door; a pair of raised dog portions on the second gear; a pair of pins extending from the output shaft, so that when the second gear is rotated by the motor, the raised dog portion engages the pin on the output shaft and moves the door from a first closed position to a second opened position; and when the door is manually moved between open and closed positions, the pins travel within a free travel space between the raised dog portions and do not engage the raised dog portions, allowing the door to rotate freely on the output shaft; the first and second gears and motor not rotating during manual operation of the door.

Therefore, it a principal object of the present invention to provide an automatic door opener adaptable to manual doors, which allow manual operation of the door without engaging any component of the automatic door opener.

It is a further object of the present invention to provide an automatic door opener adaptable to manual doors which allows the automatic opening and closing of the door by engaging a power button on the door frame, yet would allow manual operation of the door when the power button is not engaged, and no components of the automatic door opener would be engaged during the manual operation.

It is a further object of the present invention to provide an automatic door opener for a manually operated door, which includes a mechanism for imparting rotation of the door between opened and closed positions, automatically, yet would allow free rotation of the door between opened and closed position when manual force is placed upon the door, so that the automatic opener is completely disengaged in neutral during manual operation.

BRIEF DESCRIPTION OF THE SEVERAL VIEW OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
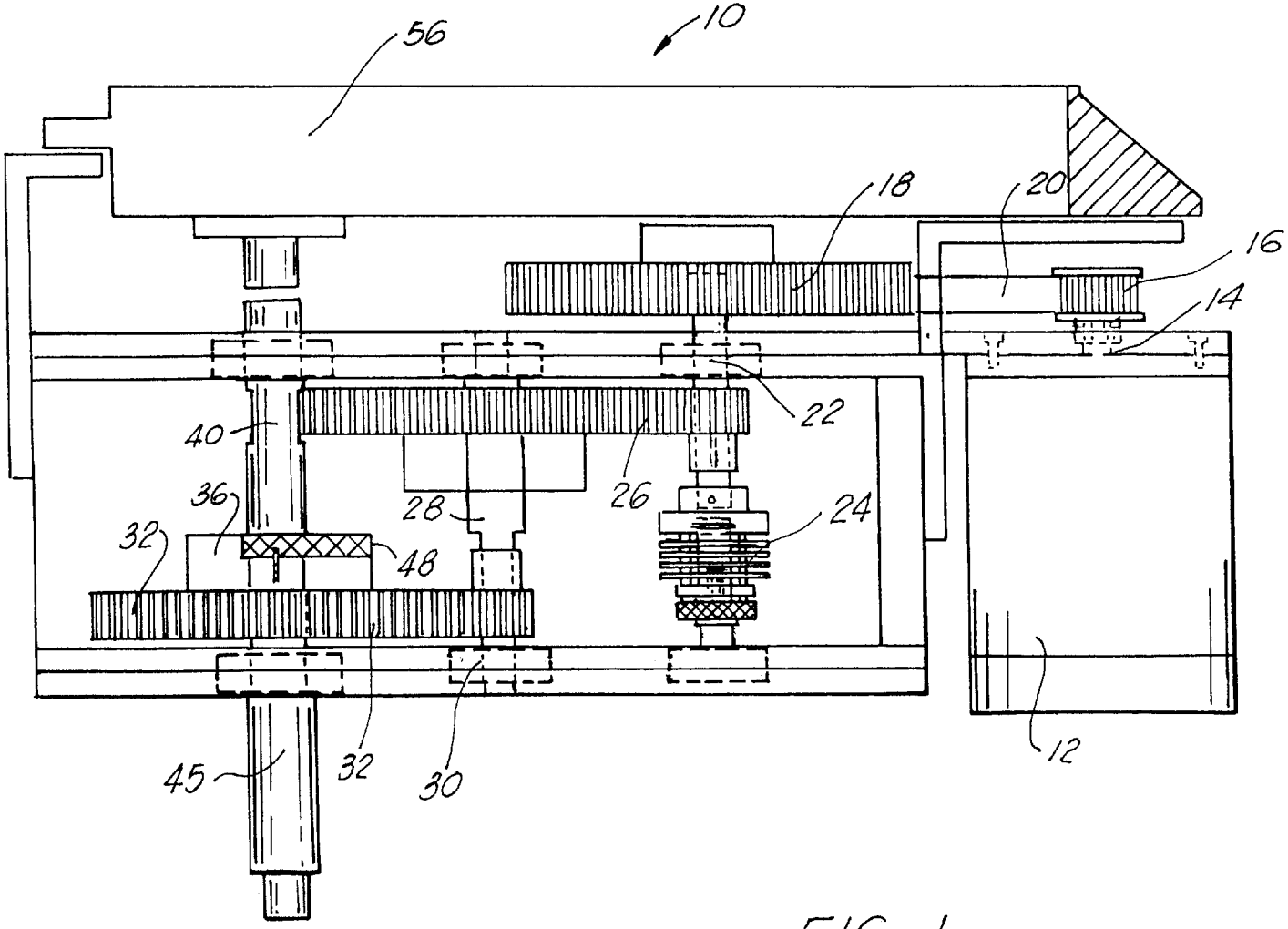
FIG. 1 illustrates an overall view of the preferred embodiment of the automatic door opener of the present invention.
Figure 2:
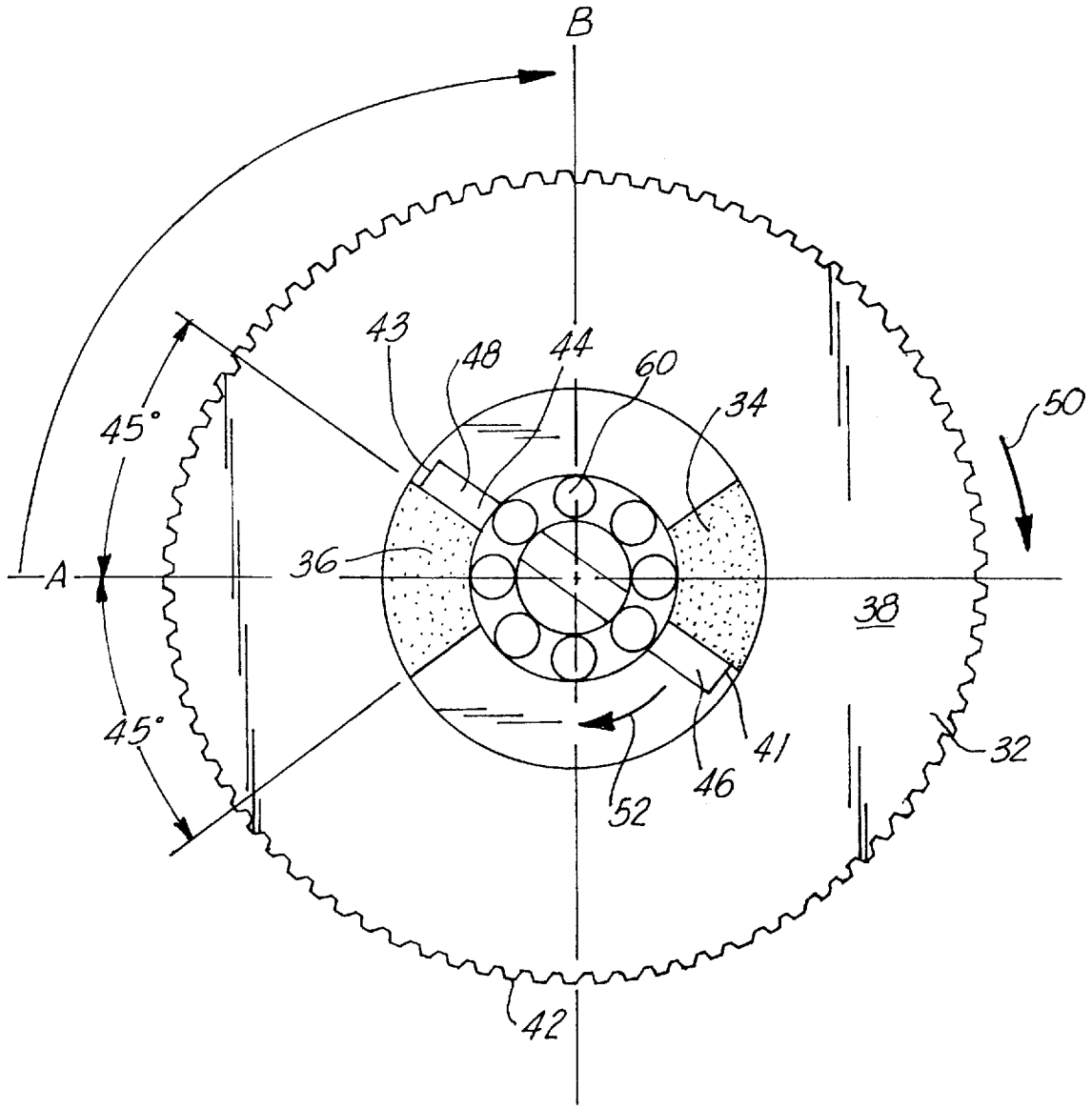
FIG. 2 illustrates a top view of the automatic door opener of the present invention as it engages the output shaft of the door.
Figure 3:
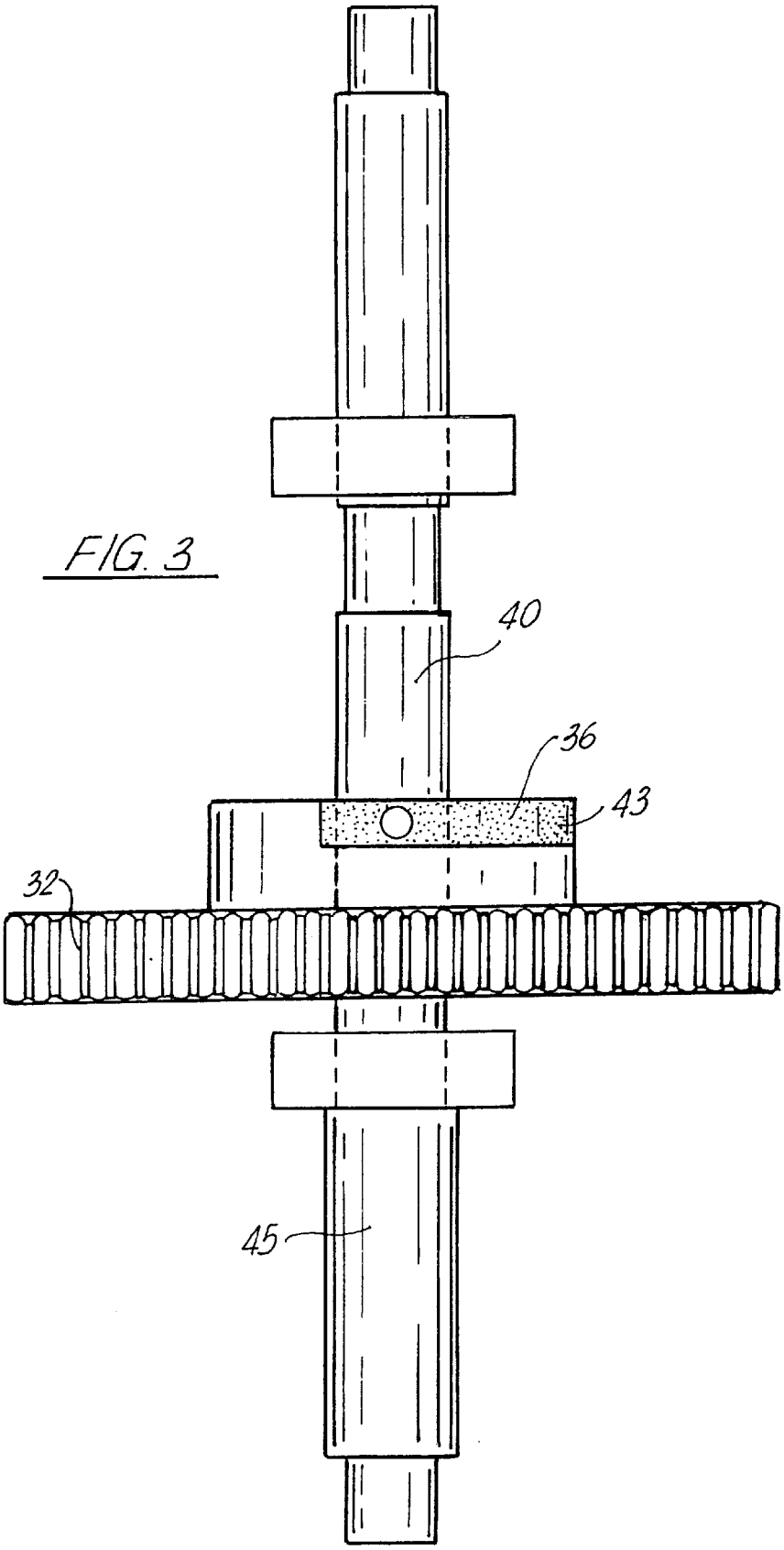
FIG. 3 illustrates a side view of the output shaft as it is mounted onto a door in the preferred embodiment of the present invention.

FIGS. 1–3 illustrate the preferred embodiment of the apparatus and system of the present invention by the numeral 10. What is provided in the automatic door opener of the present invention is a mechanism for allowing a door to be opened automatically through the pressing of an electronic switch and to close automatically, or to operate manually and when operated manually does not affect the automatic operation of the door. As seen in FIG. 1, there is illustrated a 115 direct current motor 12 which has a shaft 14 having a drive gear 16 secured to its end. The drive gear 16 is attached to a principal gear 18 through the use of a conventional drive belt 20 so that when the drive gear 16 is rotated, the gear 18 is likewise rotated. The gear 18 is mounted to the end a vertical shaft 22, the lower portion of which includes a clutch member 24 for allowing the gear to freely rotate when need be. As illustrated, there is an additional gear member 26 which meshes directly with shaft 22 so that as shaft 22 is rotated via the belt 20, the gear 26 is likewise rotated. Gear 26 is likewise mounted on the end of a shaft 28 which imparts additional rotation through a lower gear 30 to the output drive gear 32. The output drive gear 32 is seen in top view in FIG. 2.

As illustrated, output drive gear 32 includes a pair of spaced apart truncated pie-shaped members or gear dogs 34, 36 which are raised from its face 38 and with each dog 34, 36 having drive edges 41, 43 which are used to rotate the door. Each gear dog member 34, 36 further define traveling spaces 35, 37 therebetween along the face of gear 32. As seen in FIG. 3, there is illustrated an output shaft 45 which would be secured to the door at one end, and would travel through an opening 47 in drive gear 32, and would connectedly engage to a manual door opener 50 positioned above the automatic drive mechanism 10 accommodate a door so that when the shaft is rotated a door would rotate. As seen in FIG. 2, Shaft 40 includes a pin dog member 44 through its body, the pin member 44 having a pair of ends 46, 48 extending outward from each sides of the shaft. The pin ends 46, 48 each would rest in a free travelling spaces 35, 37 respectively. As illustrated, as gear 32 is rotated in the direction of arrow 50, the drive edge 41, 43 of the gear dogs 34,36 make contact with the pin ends 46, 48 respectively, and impart rotation to the shaft 40 by moving pin ends 44, 46 in the direction of arrow 52. Therefore, the door which is secured to one end of shaft 40 is likewise rotated to approximately a 90 degree path from a first closed position to a second open position; the closed position designated as line A and rotated to the open position in line B, in FIG. 2 There is included an operational power button on the door frame so that when the power button 54 is activated, it impacts power to the motor which in turn, rotates the various gears and which results in the automatic opening of the door member from the closed position A to the open position B. There is also incorporated a timer into the mechanism so after the door has been maintained in the opened position a sufficient amount of time for allowing a person in a wheelchair, a walker, or the like, to move through the opening, the manual door opener 50, as seen in FIG. 1, would then allow the shaft to rotate in the opposite direction which would have gear dogs 34, 36 to impart opposite rotation to pins 46, 48 so the door would then move from the open position B to the closed position A. Therefore, after a door has been opened from the first to the second positions by the automatic mechanism, the return of the door would impart rotation to the moving parts of the automatic door mechanism.

However, in the event that a person would want to walk through the door and not hit the power button 54, a person would place force on the door, and because shaft 40 is not connectedly engaged to gear 32, it is free to rotate on an axis within the port 42 as seen in FIG. 2, through a series of bearings 60 supporting its travel path. The free rotation of the shaft 40 is allowed because the pin ends 46, 48 would travel through free travel spaces 35, 37, since pin members 46, 48 would not be making contact with the gear dogs 34, 36. The door would then swing open to point B after the person has walked through the door, and the manual closer 56 would then rotate the door back from the position B to the position A, again through the free rotation around bearings 60, and the door would close. The benefit of the operator is that when the door is manually operated, there is movement of the power components of the system, and therefore no wear and tear of the gear mechanism as seen in FIG. 1. The output shaft 40 rotates freely when it is in the manual position since pins 46, 48 are not making any contact with gear dogs 34, 36 and are simply rotating on their free access bearing 60.

PARTS LIST

The following is a list of suitable parts and materials for the various elements of the preferred embodiment of the present invention.

| Description | Part No. |
|---|---|
| apparatus | 10 |
| motor | 12 |
| shaft | 14 |
| drive gear | 16 |
| principal gear | 18 |
| drive belt | 20 |
| vertical shaft | 22 |
| clutch member | 24 |
| gear member | 26 |
| shaft | 28 |
| lower gear | 30 |
| door drive gear | 32 |
| dogs | 34, 36 |
| free traveling spaces | 35, 37 |
| face | 38 |
| shaft | 40 |
| drive edges | 41, 43 |
| port | 42 |
| pin dog member | 44 |
| output shaft | 45 |
| pin ends | 46, 48 |
| opening | 47 |
| manual door opener | 50 |
| arrow | 52 |
| line | A |
| line | B |
| power button | 54 |
| bearings | 60 |

The foregoing embodiments are presented by way of example only; the scope of the present invention is to be limited only by the following claims.

I claim:

1. An automatic door opener comprising:

a) an automatic door opener mechanism secured between a door and a door frame, wherein said door is manually moveably between open and closed positions the opener mechanism further comprising:

i. a motor;

ii. a first drive gear driven by the motor;

iii. at least an output gear for driving an output shaft secured to the door;

iv. a pair of gear dog portions on a face of the output gear, each defining a free travel space therebetween;

v. a pair of pins extending outward from the output shaft within the free travel spaces, so that when the door opener is activated, the output gear is rotated by the motor, and the gear dog portions engage the pins on the output shaft which rotates the door from a first closed position to a second open position; and when the door is manually rotated, the pin members on the output shaft are allowed to travel freely within the free travel space between the gear dog portions as the output shaft is rotated without imparting rotation to any component of the automatic door opener.

2. The apparatus in claim 1, further comprising a timer for allowing the door to remain in the open position a predetermined amount of time before returning to the closed position when the door is activated for automatic operation.

3. The apparatus in claim 1, further comprising a clutch member for allowing free rotation of the first drive gear when the door returns to the closed position while in automatic operation.

4. The apparatus in claim 1, further comprising a manual door opener secured to the door and the frame for assisting in the manual opening and closing of the door.

5. The apparatus in claim 1, further comprising at least a third gear intermediate the first drive gear and the output gear for achieving operation of the automatic door opener.

6. The apparatus in claim 1, further comprising a set of bearings positioned around the output shaft for allowing ease of rotation of the door on the output shaft when manually operated.

7. The apparatus in claim 1, wherein the automatic door opener is electrically powered.

8. An automatic door opener comprising:

a) an automatic door opener mechanism secured between a door and a door frame wherein said door is manually movable between open and closed positions, further comprising:

i. a motor activated by a person moving through the door;

ii. a first drive gear driven by the motor;

iii. at least an output gear driven by the first gear for rotating an output shaft secured to the door;

iv. a pair of gear dog portions on the second gear defining free travel spaces therebetween;

v. a pin with two ends extending from the output shaft, so that when the output gear is driven by the motor, the gear dog portions engage the pin ends on the output shaft and move the door from a first closed position to a second open position;

vi. a timer for allowing the door to remain in the open position a predetermined amount of time before returning to the closed position; and vii. when the door is moved manually to the open position and allowed to close, the output shaft rotates freely on its axis without the pair of pin ends engaging the gear dog portions, thus avoiding any movement of the components of the automatic door opener mechanism.

9. The apparatus in claim 8, further comprising a manual door opener secured to the door and the frame for assisting in the manual opening and closing of the door.

10. The apparatus in claim 8, further comprising at least a third gear intermediate the first drive gear and the output gear for achieving operation of the automatic door opener.

11. The apparatus in claim 8, further comprising a set of bearings positioned around the output shaft for allowing ease of opening and closing of the door when manually operated.

12. The apparatus in claim 8, wherein the automatic door opener is electrically powered.

13. An automatic door opener used in combination with a manual door of a type positioned within a door frame and hinged along at least one edge for manual movement between open and closed positions, the automatic door opener comprising:

a) a motor activated by a person moving through the door;

b) a first drive gear driven by the motor;

c) at least an output gear driven by the first gear for rotating an output shaft secured to the door;

d) at least one gear dog portion on the second gear;

e) at least one pin extending from the output shaft, so that when the output gear is driven by the motor, the gear dog portion engages the pin on the output shaft and moves the door from a first closed position to a second open position, but when the door is moved manually between an open position and close position, the gear dog portion does not engage the pin on the output shaft, thus avoiding any movement of the component parts of the automatic door mechanism during manual operation of the door.

14. The apparatus in claim 13, further comprising a timer for allowing the door to remain in the open position a predetermined amount of time before returning to the closed position.

* * * * *